US006620031B2

(12) United States Patent
Renteln

(10) Patent No.: US 6,620,031 B2
(45) Date of Patent: Sep. 16, 2003

(54) METHOD FOR OPTIMIZING THE PLANARIZING LENGTH OF A POLISHING PAD

(75) Inventor: Peter Renteln, San Ramon, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/825,643

(22) Filed: Apr. 4, 2001

(65) Prior Publication Data

US 2002/0146966 A1 Oct. 10, 2002

(51) Int. Cl.[7] ..... B24B 1/00

(52) U.S. Cl. ..... 451/41; 451/526; 451/527; 451/529

(58) Field of Search ..... 451/41, 56, 59, 451/21, 296, 28, 285–289, 307, 526–529, 538, 539

(56) References Cited

U.S. PATENT DOCUMENTS

| | | | | |
|---|---|---|---|---|
| 5,212,910 A | | 5/1993 | Breivogel et al. | |
| 5,297,364 A | | 3/1994 | Tuttle | |
| 5,441,598 A | | 8/1995 | Yu et al. | |
| 5,489,233 A | | 2/1996 | Cook et al. | |
| 5,645,469 A | | 7/1997 | Burke et al. | |
| 5,650,039 A | | 7/1997 | Talieh | |
| 5,658,183 A | | 8/1997 | Sandhu et al. | |
| 5,690,540 A | | 11/1997 | Elliott et al. | |
| 5,779,526 A | | 7/1998 | Gill | |
| 5,876,268 A | * | 3/1999 | Lamphere et al. | 451/41 |
| 5,882,251 A | * | 3/1999 | Berman et al. | 451/285 |
| 5,888,121 A | * | 3/1999 | Kirchner et al. | 451/41 |
| 5,908,477 A | * | 6/1999 | Harmer et al. | 451/59 |
| 5,984,769 A | | 11/1999 | Bennett et al. | |
| 6,099,390 A | * | 8/2000 | Nishio et al. | 451/36 |
| 6,108,091 A | | 8/2000 | Pecen et al. | |
| 6,111,634 A | | 8/2000 | Pecen et al. | |
| 6,120,366 A | | 9/2000 | Lin et al. | |
| 6,146,248 A | | 11/2000 | Jairath et al. | |
| 6,155,910 A | * | 12/2000 | Lamphere et al. | 451/41 |
| 6,238,271 B1 | * | 5/2001 | Cesna | 451/41 |
| 6,241,596 B1 | * | 6/2001 | Osterheld et al. | 451/41 |

FOREIGN PATENT DOCUMENTS

| | | |
|---|---|---|
| EP | 0 878 270 A2 | 11/1998 |
| WO | WO 99/06182 | 2/1999 |
| WO | WO 00/71297 A1 | 11/2000 |

OTHER PUBLICATIONS

U.S. patent application Ser. No. 09/316/166: "Chemical Mechanical Planarization or Polishing Pad with Sections having Varied Groove Patterns"; Inventors: Jensen et al.; Filed: May 21, 1999; Attorney Docket No. 7103–68.

* cited by examiner

*Primary Examiner*—Joseph J. Hail, III
*Assistant Examiner*—David B. Thomas
(74) *Attorney, Agent, or Firm*—Brinks Hofer Gilson & Lione

(57) ABSTRACT

A method for optimizing the planarizing length of a polishing pad is disclosed that includes forming a substantially constant network of islands and trenches into a first side of a polishing pad. The trenches are formed to a pre-determined distance apart. The polishing pad is fit to a chemical-mechanical polishing system. A surface layer of a semiconductor wafer is planarized with the first side of the polishing pad. Upon completion of the polishing process, the planarized wafer surface layer is observed. If the wafer surface layer is planarized to an amount outside of a set target polishing range, the distance between the trenches on the first side of the polishing pad is uniformly decreased. The above steps are repeated until the wafer surface layer is planarized to an amount within the set target polishing range.

26 Claims, 4 Drawing Sheets

METHOD FOR OPTIMIZING THE PLANARIZING LENGTH OF A POLISHING PAD

FIELD OF THE INVENTION

The present invention relates to a method for optimizing the planarizing length of a polishing pad used for polishing thin films. More particularly, the present invention relates to a method for optimizing the planarizing length of a polishing pad for use in chemical mechanical polishing/planarization of semiconductor wafers.

BACKGROUND

When raw silicon wafers are manufactured, they commonly have surface irregularities on the wafer surface as a result of the manufacturing process. Semiconductor wafers are made from these raw wafers, and are commonly constructed in layers, where active devices are created on a first level and interconnecting conductive lines are created on upper layers. Conductive vias are fabricated to connect up levels of the circuit. In one common process, after each layer of the circuit is fabricated, an oxide or metal layer is deposited. A masking, etching and deposition process allows the vias to pass from layer to layer. Each oxide layer can create or add unevenness to the wafer that must be smoothed out before generating the next circuit layer. However, the unevenness must be smoothed out without smoothing out the irregularities in the silicon, which are reproduced at the oxide surface. Smoothing out the irregularities on the wafer surface will result in the oxide layer pitting and the wafer being unusable.

Chemical mechanical planarization (CMP) techniques are used to planarize the oxide or metal layers. Available CMP systems, commonly called wafer polishers, often use a rotating wafer carrier head that brings the wafer into contact with a polishing pad rotating in the plane of the wafer surface to be planarized. A chemical polishing agent or slurry containing microabrasives is applied to the polishing pad to polish the wafer. The wafer carrier head then presses the wafer against the rotating polishing pad and is rotated to polish and planarize the wafer. The mechanical force for polishing is derived from the rotating table speed and the downward force on the wafer carrier head. The chemical slurry is constantly transferred under the wafer carrier head. Rotation of the wafer carrier head helps in the slurry delivery as well in averaging the polishing rates across the substrate surface.

Another technique for performing CMP to obtain a more uniform polishing rate is the use of a linear polisher. Instead of a rotating polishing pad, a polishing pad linearly moves across the wafer surface. The wafer is still rotated to average out the local variations. An example of a linear polisher is the TERES™ polisher available from Lam Research Corporation of Fremont, Calif.

With either type of polisher (linear or rotary), the polishing pad is an important part of the CMP system. To be effective, the polishing pad should have a high planarizing capability. One factor that determines the planarizing capability of a polishing pad is the pad's planarizing length. The planarizing length is the lateral distance over which the polishing pad planarizes the surface of the wafer. The planarizing length may be engineered to a large range of values. However, a desired, or optimal planarizing length is the lateral distance over which the polishing pad polishes the unevenness on the wafer surface without planarizing the wafer itself. If the planarizing length exceeds this distance, pitting will occur on the wafer surface.

One method of producing a polishing pad with high planarizing capabilities involves applying a fixed abrasive to the surface of the polishing pad. The fixed abrasive is a hard abrasive that is embedded into pyramid-shaped cones in the polishing surface. The cones have flat tops, and are joined at the base to form a continuous material. However, the hard abrasive material has a tendency to scratch wafers, and is also expensive.

BRIEF SUMMARY

A method for optimizing the planarizing length of a polishing pad is provided herein. According to a first aspect of the method, a substantially constant network of islands and trenches is formed into a first side of a polishing pad. The trenches are formed to a pre-determined distance apart. The polishing pad is fit to a chemical-mechanical polishing system. A surface layer of a semiconductor wafer is planarized with the first side of the polishing pad. Upon completion of the polishing process, the planarized wafer surface layer is observed. If the wafer surface layer is planarized to an amount outside of a set target polishing range, the distance between the trenches on the first side of the polishing pad is uniformly decreased. The above steps are repeated until the wafer surface layer is planarized to an amount within the set target polishing range.

According to another aspect of the method, a substantially constant network of islands and trenches is formed into a surface of a polishing pad. The trenches are formed to a pre-determined distance apart. The polishing pad is fit to a chemical-mechanical polishing system, and a surface layer of a semiconductor wafer is polished with the surface of the polishing pad. Upon completion of the polishing process, the planarized wafer surface layer is observed. If the wafer surface layer is planarized to an amount within a set target polishing range, the polishing pad is removed from the chemical-mechanical polishing system. A substantially constant network of islands and trenches is formed into a surface of a new polishing pad, with the distance between the trenches being uniformly increased. The above steps are repeated until the wafer surface layer is planarized to an amount outside of the set target polishing range.

The foregoing discussion of the preferred embodiments has been provided only by way of introduction. Nothing in this section should be taken as a limitation on the following claims, which define the scope of the invention.

DETAILED DESCRIPTION OF THE PRESENTLY PREFERRED EMBODIMENTS

Figure 1:
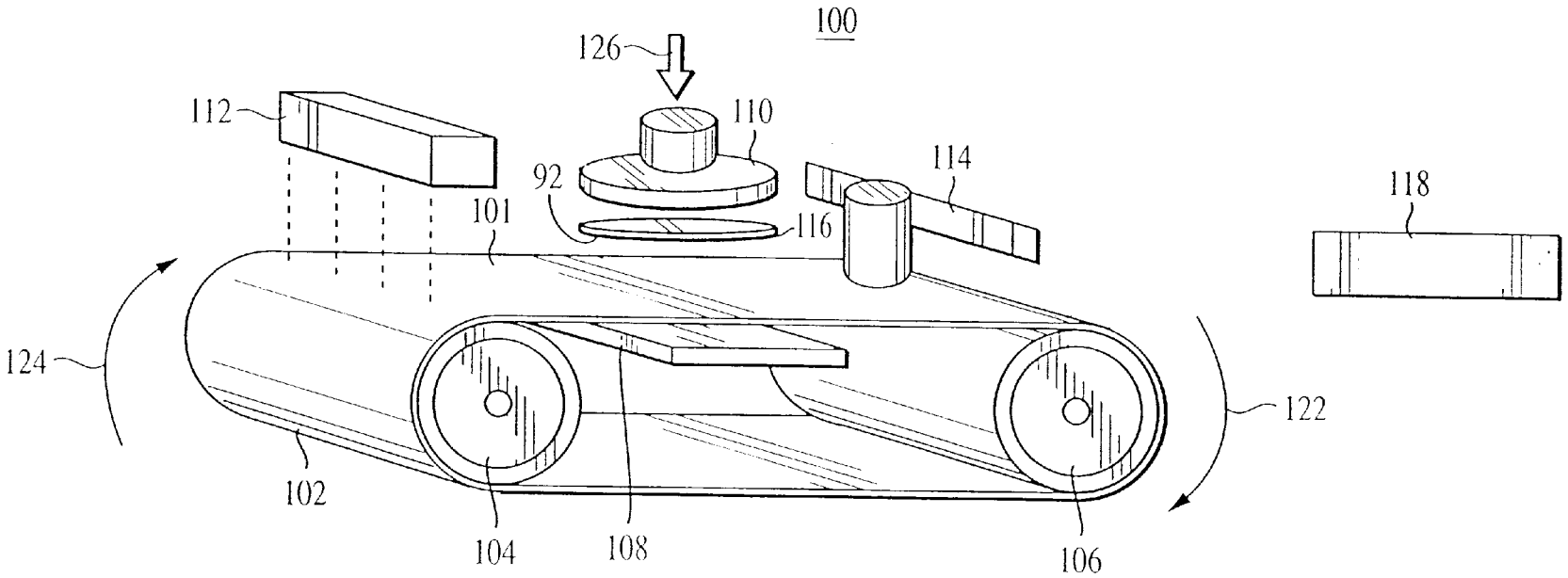
FIG. 1 is a perspective view of an embodiment of a linear chemical mechanical polishing system.

By way of introduction, FIG. 1 illustrates a linear chemical mechanical polishing or planarization (CMP) system 100 for polishing a workpiece. The system 100 includes a polishing pad 102 having a polishing surface 101, a first roller 104, a second roller 106, a platen 108, a polishing head 110, a slurry dispenser 112, a conditioner 114, and a controller 118. The system 100 in the illustrated embodiment is adapted for the planarization of wafers such as the semiconductor wafer 116.

Figure 5:
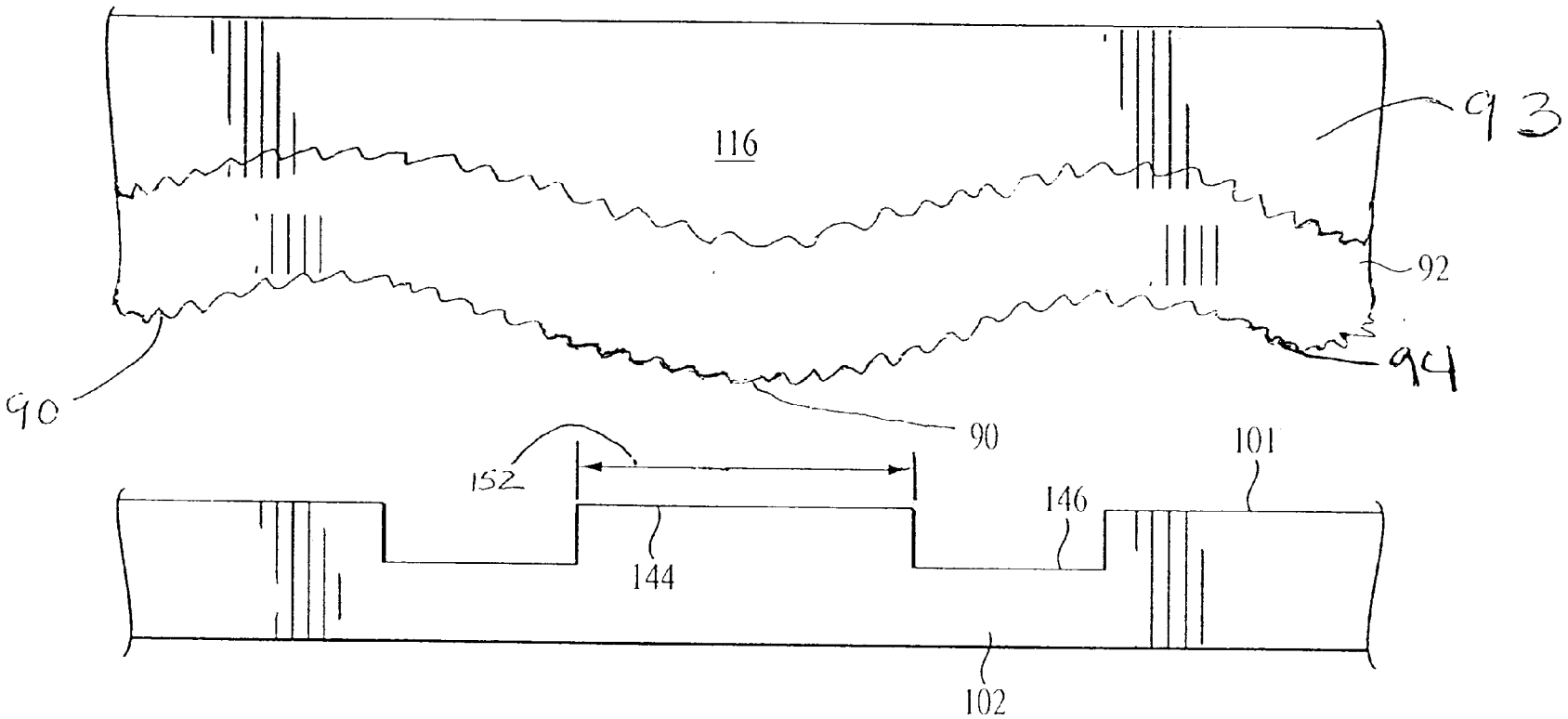
FIG. 5 is a side cross-sectional view of a polishing pad opposite a semiconductor wafer.

As shown in FIG. 5, the semiconductor wafer 116 includes uniformly spaced peaks 90 that protrude outwardly from the wafer 116, a film surface layer 92, and a bottom layer 93. The film surface layer 92 preferably is an oxide film that is deposited over the bottom layer 93. Film layer 92 has features 94 that are the result of conforming to the shape of bottom layer 93 when it is deposited over bottom layer 93. Although a preferred embodiment includes a semiconductor wafer having an oxide film, the operative principles embodied in the system 100 may be applied to chemical mechanical polishing of other workpieces as well.

The rollers 104, 106 are located a predetermined distance apart to retain the polishing pad 102 and move the polishing pad 102 to permit linear planarization of the wafer 116. The rollers 104, 106 are turned, for example, by an electric motor in the direction indicated by the arrows 122, 124 in FIG. 1. The rollers 104, 106 thus form a transport for moving the belt in a continuous loop past the workpiece, wafer 116. Other methods of transport include utilizing combinations of wheels, pulleys and tensioning devices, along with their associated drive elements such as electric motors and mechanical linkages. Operational parameters such as the speed and tension of the polishing pad 102 are controlled through the rollers 104, 106 by the controller 118. The controller 118 may include a processor or other computing device that operates in response to data and instructions stored in an associated memory.

The wafer 116 is mounted on the polishing head 110. The wafer 116 may be mounted and retained in place by any number of techniques, including, by way of example, a vacuum force. The polishing head 110 is mounted on an arm and is movable to an extent under control of the controller 118. The polishing head 110 applies a polishing pressure to the wafer 116 against the polishing pad 102. The polishing pressure is indicated in FIG. 1 by the arrow 126.

To further control the polishing pressure, the platen 108 is located opposite the polishing head 110 below the wafer 116. The polishing pad 102 passes between the film surface layer 92 of the wafer and the platen 108. The platen 108 applies pressure to the polishing pad 102. In some applications, the platen 108 is arranged to apply pressure in controllable zones or areas of the platen 108 under control of the controller 118. For example, the zones may be arranged radially on the surface of the platen 108. This controlled application of pressure through the platen 108 allows the polishing pad 102 to polish uniformly across the film surface layer 92 of the wafer 116.

The slurry dispenser 112 dispenses a slurry onto the polishing pad 102. The slurry is a fluid containing microabrasives and/or a desired chemistry. The slurry is applied to the polishing pad 102 to polish the film surface layer 92 of the wafer 116. The exact components of the slurry are chosen based on the material to be polished or planarized. For uniform planarization or polishing, the slurry should be distributed evenly across the film surface layer 92 of the wafer 116.

The conditioner 114 treats the polishing surface 101 of the polishing pad 102 to keep its roughness or abrasiveness relatively constant. As the polishing pad 102 planarizes or polishes the wafer 116, there is some deposit of the material removed from the wafer 116 and onto the polishing surface 101 of the polishing pad 102. If too much material from the surface 130 of wafer 116 is deposited on the polishing pad 102, the removal rate of the polishing pad 102 will drop quickly and the uniformity of abrasion across the wafer 116 will be degraded. The conditioner 114 cleans and roughens the polishing surface 101 of the polishing pad 102. A preferred CMP system for transporting a polishing pad is the TERES™ CMP system.

The polishing pad 102 is preferably an endless-loop polishing pad. In its simplest form, the polishing pad 102 is made with a single endless layer that provides both the polishing surface 101 for polishing and the mechanical strength for mounting, tensioning and tracking the belt on the rollers 104, 106. Suitable polishing pad materials include rubbers or plastics, including but not limited to, polyureas, polyesters, polyethers, epoxies, polyamides, polycarbonates, polyetheylenes, polypropylenes, fluoropolymers, vinyl polymers, acrylic and methacrylic polymers, silicones, latexes, nitrile rubbers, isoprene rubbers, butadiene rubbers, and various copolymers of styrene, butadiene, and acrylonitrile.

In a preferred embodiment, the polishing pad 102 for polishing a workpiece such as the wafer 116 in the CMP system 100 includes a blown polyurethane layer forming an endless loop having a predetermined width and a predetermined length to fit the CMP system 100. As described above, the polishing pad 102 has a polishing surface 101 on one side of the endless loop.

However, in other embodiments, the polishing pad may be a strip pad. Rather than an endless loop pad, a strip pad has a first end and an opposing second end. The first end and second end of the strip pad are each attached with a roller. When the polishing pad is moving, the rollers will transport the pad in the direction of the first end, with the pad winding around the roller associated with the first end of the pad. When travel in the first direction is completed, the rollers will transport the pad in the opposite direction, with the pad winding around the roller associated with the second end of the pad. This process is then repeated.

Typically, a top surface 140 of the polishing pad 102 will be the polishing surface 101. However, in other embodiments, the polishing pad may be reversible, and in different configurations a bottom, or opposing, surface may be the polishing surface. Alternatively, in additional other embodiments both the top and bottom surfaces of the polishing pad may be used for polishing at the same time.

The polishing pad 102 can be solid, porous, or both. In a preferred embodiment, the polishing pad 102 is approximately 60–80% solid, with the remainder of the polishing pad 102 being porous. While porosity is not required, it assists the polishing process by carrying the slurry to the film surface layer 92 of the wafer 116. Examples of some belts are the RODEL IC1000 belt or the MADISON belt.

As noted and described above, one embodiment describes the polishing pad 102 as a single layer polishing pad that is utilized on a linear CMP system 100. In an alternative embodiment, the polishing pad can have multiple layers, or what is known as a "stacked" configuration. In one embodiment, by way of example, a two-layer polishing pad will have a polishing layer as described above and a polymeric layer that provides a desired effect. For example, putting a softer underlayer beneath the harder polishing layer maintains the overall rigidity of the polishing pad but still allows enough softness so that the polishing layer can flex to conform to the surface of the wafer. Thus, by adding additional layers, the polishing performance of the polishing pad can be tailored to the workpiece or to the CMP system.

Any suitable method can be used for attaching the second layer and any subsequent layers to the polishing layer. In one example, the second layer may be cast directly onto the polishing layer. Another suitable method for adding a second layer to the polishing layer is to adhesively combine the second layer with the polishing layer.

In another embodiment, the multiple-layer polishing pad may be reversible, and both surfaces of the polishing pad may be used for polishing at the same or different times. The two surfaces may be used for different types of polishing operations, and multiple-layer polishing pads may comprise different materials tailored to different polishing applications.

In another embodiment, a rotary CMP system, rather than a linear system, may be used. In a rotary CMP system, a polishing pad rotates in the plane of a wafer surface to be planarized, rather than moving linearly across the wafer surface. A rotating wafer carrier head brings the wafer into contact with the polishing pad. Slurry is applied to the polishing pad to polish the wafer. The wafer carrier head then presses the wafer against the rotating polishing pad, and is rotated to polish and planarize the wafer. The mechanical force for polishing is derived from the rotating table speed and the downward force on the wafer carrier head. Either a single layer polishing pad or a multi-layer configuration may be used with the rotary CMP system.

Figure 2:
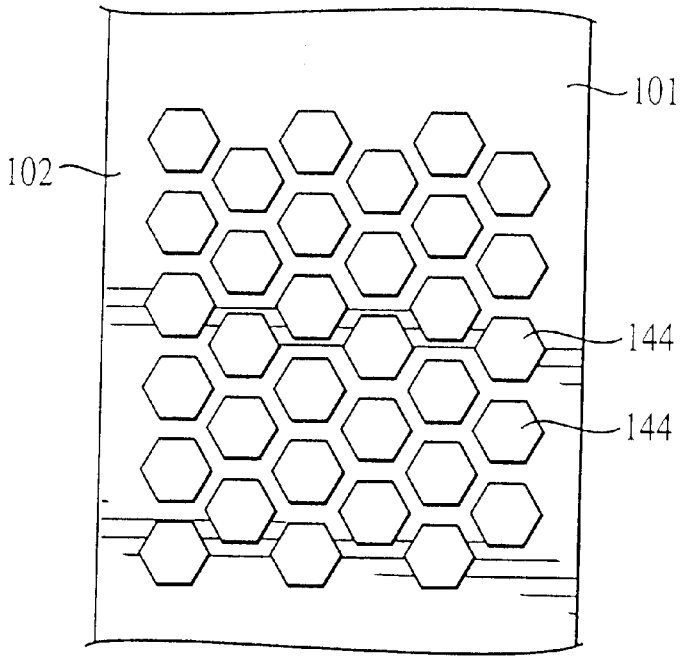
FIG. 2 is a top plan view of a polishing pad.
Figure 3:
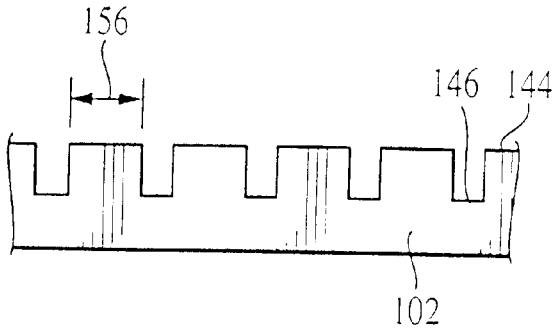
FIG. 3 is a front plan view of the polishing pad of FIG. 2.

Referring now to FIGS. 2, 3 and 5, the polishing surface 101 has a network of islands 144. The islands 144 may have any design, dimension, shape, or pattern to effectuate polishing. The islands 144 are substantially uniform in size. Surrounding the islands 144 are trenches 146, which are formed at a pre-determined depth. The islands 144 and trenches 146 should be formed so that the polishing pad 102 has a high planarizing capability.

Figure 4:
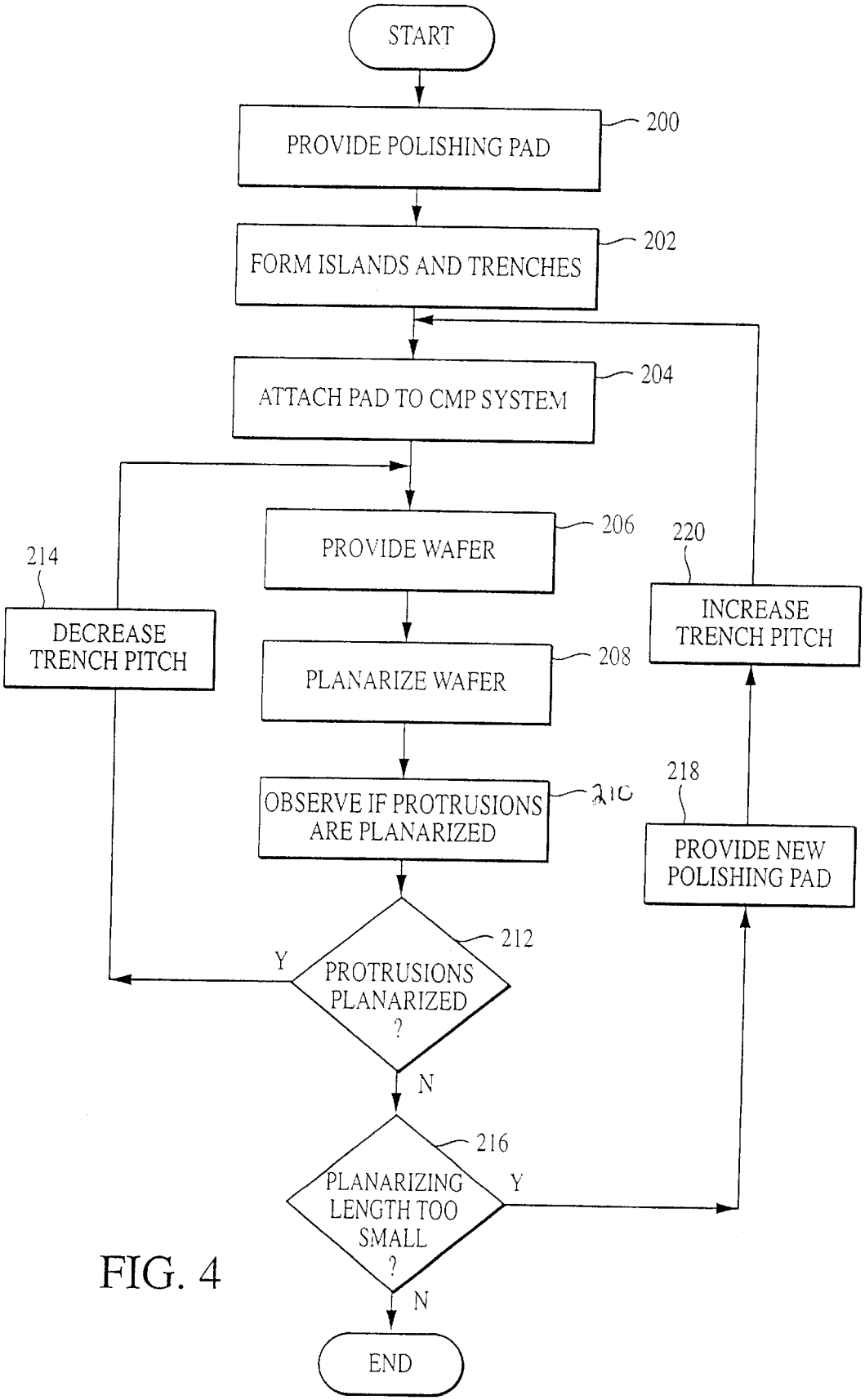
FIG. 4 is a flow diagram illustrating a method for optimizing the planarizing length of the polishing pad of FIG. 2.

One factor that influences the planarizing capability of the polishing pad 102 is the planarizing length. The planarizing length is the lateral distance over which the polishing pad 102 planarizes the film surface layer 92 of the wafer 116. An optimal planarizing length, shown as 152 in FIG. 5, is the largest length that will allow the imperfections to be polished without planarizing the peaks 90. If the planarizing length exceeds this distance, pitting will occur on the film surface layer 92, rendering the wafer 116 unusable. If the planarizing length is less than planarizing length 152, the features 94 will not be fully polished and imperfections may remain on the wafer 116. FIG. 4 is a flow diagram illustrating a method for achieving an optimal planarizing length 152.

As illustrated, a polishing pad is provided (200). The pad may be made by any suitable manufacturing method. Examples of such methods include but are not limited to extrusion, injection molding, hot casting, pressing, rotational molding, and centrifugal molding.

In a preferred embodiment, the polishing pad is made of a blown polyurethane material. However, the polishing pad can be made of any suitable polishing material. Additionally, a polishing pad with multiple layers can be made by directly forming one layer to the next, as described above.

In a preferred embodiment a substantially uniform network of islands and trenches are formed into the entire polishing surface of the polishing pad (at 202), although in other embodiments, depending on the application involved, the islands and trenches may be formed into less than the entire surface. The islands and trenches may be molded into the polishing pad surface via the molding methods described at 200. The islands and trenches may also be machined by such operations as, by way of example, milling, cutting, sawing, lathing, embossing, and laser ablating. Preferably, the trench depth will be approximately one-half the thickness of the polishing pad, although the depth of the trenches may be other values as well.

The islands may be formed to a variety of shapes. Examples include, but are not limited to, triangles, parallelograms, hexagons, octagons or diamonds. Preferably, the islands and trenches will be formed so that the polishing pad material removed to form the islands and trenches is less than the polishing pad material remaining on the polishing pad. In a preferred embodiment, the trenches will be formed in a "criss-cross" pattern so that diamond-shaped islands will be formed.

The lateral distance of an island defines the planarizing length of the polishing pad. In a preferred embodiment, diamond-shaped islands will be formed so that each island is 1.0 cm per edge. However, the islands may be other sizes also, depending on the thickness and stiffness of the polishing pad material used. Generally, as with the trench depth, the thicker and stiffer the polishing pad, the smaller the island size will be when the largest optimal planarizing length is achieved.

The polishing pad, with the islands and trenches, is attached to the CMP system (at 204). The rollers, located a predetermined distance apart, retain the polishing pad and move the polishing pad to permit linear planarization of the wafer. Alternatively, the polishing pad can also be attached to the rotary CMP system described above.

A semiconductor wafer having a film surface layer, preferably an oxide layer, for polishing is provided (at 206). As discussed previously, although semiconductor wafers are used, the method embodied herein may be applied to the chemical mechanical polishing of other workpieces as well.

The wafer is planarized and polished with either a rotary or linear CMP system (at 208). Rotary CMP systems use a rotating wafer carrier head that brings the wafer into contact with the top surface of a polishing pad rotating in the plane of the wafer surface to be planarized. A chemical polishing agent or slurry containing microabrasives is applied to the polishing pad to polish the wafer. The wafer carrier head then presses the wafer against the rotating polishing pad and is rotated to polish and planarize the wafer.

Alternatively, a linear CMP system can also be used to planarize and polish the wafer. Instead of a rotating pad, the wafer carrier head brings the wafer into contact with a polishing pad that linearly moves across the wafer surface. As with the rotary CMP system, the wafer is still rotated to average out the local variations. Whether utilizing a rotary or linear CMP system, a wafer is planarized when a preset, substantially uniform film surface layer thickness is achieved.

Next, the film surface layer of the polished wafer is observed to determine if the peaks have been planarized (at 210). In a preferred method, this is accomplished by measuring the film surface layer thickness of the polished wafer. Ideally, a wafer will be uniformly polished and the entire surface will have an equal film surface layer reduction. However, there may be small variances in the amount the film surface layer has been reduced. If these variances fall within a target thickness range, the wafer has been properly planarized.

A metrology tool may be used to optically measure the film surface layer thickness after polishing. The metrology tool measures the film surface layer thickness at a plurality of positions on the film surface layer. Each position measured is then compared to the target thickness range.

Preferably, the target thickness range is ±1–3% of a target thickness. For example, suppose an unplanarized wafer has a film surface layer thickness of 1 micron, or 10,000 Angstroms, and the target thickness of the film surface layer is 4,000 Angstroms. If the acceptable target thickness range is ±1%, a properly planarized wafer must have a surface layer thickness that varies between 3,960 Angstroms and 4,040 Angstroms along the wafer surface. Ideally, the target thickness range is 0%. However, in a preferred embodiment the target thickness range is ±1–3%. Furthermore, this amount may be varied depending on the application requirements.

An optimal planarizing length will remove unevenness, or topography, created in the wafer surface as a result of the wafer fabrication process without removing peaks in the wafer. If a film surface layer thickness measurement falls outside the target thickness range due to peaks having been planarized, then the planarizing length is too large (at 212). This will result in the wafer having a pitted surface and being unusable.

If the planarizing length is too large (at 212), the trench pitch needs to be decreased (at 214). The trench pitch, depicted as 156 in FIG. 3, is the distance separating the trenches, or the island size. The trench pitch is the lateral distance across the face of an island. The trench pitch is reduced by increasing the number of trenches, and hence the number of islands, formed into the polishing surface. This will have the effect of decreasing the size of the islands, and hence the planarizing length. The trench pitch may be decreased by any machining method, including but not limited to, cutting, sawing, sanding, lathing, laser ablating and the like. Preferably, the polishing pad will be removed from the CMP system when the trench pitch is decreased. The above process is then repeated, beginning at 204. This procedure is repeated each time the planarizing length is found too large.

Alternatively, if the film surface layer thickness measurements fall within the target thickness range, the peaks have not been excessively planarized. However, topography may remain on the film surface layer. The trench pitch needs to be increased to determine if the planarizing length can be increased without having the surface layer thickness of a polished wafer fall outside the target thickness range. In other words, the trench pitch needs to be increased to determine if the planarizing length is too small (at 216). As shown at 218, 220, a new polishing pad needs to be provided that has a substantially uniform network of islands and trenches having a larger trench pitch formed into the polishing pad surface as described at 200, 202 above. The process outlined above is then repeated beginning at 204. This procedure is repeated each time the planarizing length is found too small. The optimized planarizing length is the length used to polish a wafer just before the film surface layer thickness falls outside the target thickness range.

In another embodiment, the method described above may be applied to both surfaces of a reversible polishing pad of the type described above. Additionally, the method may be applied to reversible, multiple-layer polishing pads comprising different materials tailored to different polishing applications.

As can be seen from the foregoing, the present embodiments provide an improved method of providing a polishing pad with a high planarizing capability by optimizing the planarizing length of the polishing pad. Fixed abrasive materials are not required. Fixed abrasives are hard abrasives that are embedded into a polishing surface and are used in place of abrasive particles in slurry. Although fixed abrasive materials are credited with a high planarizing capability, they are also expensive and have a tendency to scratch wafers during the polishing process. Instead, standard, low-cost CMP polishing pads may be used. Special polishing tools are not required. Furthermore, pads whose planarizing lengths may not be desirable for one operation may be retained for either 1) applying the method outlined above to another application and/or 2) for future use in another planarizing operation.

The embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

I claim:

1. A method for optimizing the planarizing length of a polishing pad, comprising:

a) forming a substantially constant network of islands and trenches into a first side of a polishing pad, wherein said trenches are formed to a pre-determined distance apart;

b) fitting said polishing pad to a chemical-mechanical polishing system;

c) planarizing a surface layer of a semiconductor wafer with said first side of said polishing pad;

d) observing said planarized wafer surface layer;

e) uniformly decreasing said distance between said trenches on said first side of said polishing pad if said wafer surface layer is planarized to an amount outside of a set target polishing range; and f) repeating b through e until said wafer surface layer is planarized to an amount within said set target polishing range.

2. The method of claim 1, wherein said polishing pad further comprises an endless loop polishing pad.

3. The method of claim 2, wherein said polishing pad further comprises a multi-layer polishing pad.

4. The method of claim 1, wherein said polishing pad further comprises a strip polishing pad.

5. The method of claim 1, wherein said polishing pad further comprises a blown polyurethane material.

6. The method of claim 1, wherein said set target polishing range is ±1% of a target thickness.

7. The method of claim 1, wherein decreasing said distance between said trenches further comprises:

removing said polishing pad from said chemical-mechanical polishing system; and fitting said polishing pad to said chemical-mechanical polishing system after said distance between said trenches is decreased.

8. The method of claim 7, wherein decreasing said distance between said trenches further comprises:

forming an additional, substantially constant network of islands and trenches into said first side of said polishing pad.

9. The method of claim 7, further comprising using a lathe to form said islands and said trenches into said first side of said polishing pad.

10. The method of claim 7, further comprising using a laser to form said islands and said trenches into said first side of said polishing pad.

11. The method of claim 7, further comprising:

molding said islands and said trenches into said first side of said polishing pad through an injection-molding process.

12. The method of claim 1, wherein said islands are diamond shaped.

13. The method of claim 1, wherein said islands are square-shaped.

14. The method of claim 1, wherein said islands are triangularly shaped.

15. The method of claim 1, wherein observing said planarized wafer surface layer further comprises:

removing said wafer from said chemical-mechanical polishing system; and measuring the thickness of said polished wafer surface layer with a metrology tool.

16. The method of claim 15, wherein said polished wafer surface layer further comprises an oxide film.

17. The method of claim 1, further comprising:

forming said trenches to a depth of approximately one-half the thickness of said polishing pad.

18. The method of claim 1, further comprising:

applying the method of claim 1 to said second side of said polishing pad.

19. The method of claim 18, wherein observing said planarized wafer surface layer further comprises:

removing said wafer from said chemical-mechanical polishing system; and measuring the thickness of said polished wafer surface layer with a metrology tool.

20. The method of claim 19, wherein said polished wafer surface layer further comprises an oxide film.

21. The method of claim 18, wherein decreasing said distance between said trenches further comprises:

removing said polishing pad from said chemical-mechanical polishing system; and fitting said polishing pad to said chemical-mechanical polishing system after said distance between said trenches is decreased.

22. The method of claim 21, wherein decreasing said distance between said trenches further comprises:

forming an additional, substantially constant network of islands and trenches into said first side of said polishing pad.

23. A polishing pad manufactured according to the method of claim 1.

24. A polishing pad manufactured according to the method of claim 18.

25. A method for optimizing the planarizing length of a polishing pad, comprising:

a) forming a substantially constant network of islands and trenches into a surface of a polishing pad, wherein said trenches are formed to a pre-determined distance apart;

b) fitting said polishing pad to a chemical-mechanical polishing system;

c) planarizing a surface layer of a semiconductor wafer with said surface of polishing pad;

d) observing said planarized wafer surface layer, wherein observing said planarized wafer surface layer further comprises:

removing said wafer from said chemical-mechanical polishing system; and measuring the thickness of said polished wafer surface layer with a metrology tool;

e) removing said polishing pad from said chemical-mechanical polishing system if said wafer surface layer is planarized to an amount within a set target polishing range;

f) forming a substantially constant network of islands and trenches into a surface of a new said polishing pad, wherein said distance between said trenches is uniformly increased;

g) repeating b through f until said wafer surface layer is planarized to an unit outside of said set target polishing range.

26. The method of claim 25, wherein said polished wafer surface layer further comprises an oxide film.

* * * * *

UNITED STATES PATENT AND TRADEMARK OFFICE

CERTIFICATE OF CORRECTION

PATENT NO. : 6,620,031 B2
DATED : September 16, 2003
INVENTOR(S) : Peter Renteln It is certified that error appears in the above-identified patent and that said Letters Patent is hereby corrected as shown below:

Column 10,
Line 36, before "outside", delete "unit" and substitute -- amount -- in its place.

Signed and Sealed this

Thirteenth Day of July, 2004

JON W. DUDAS
*Acting Director of the United States Patent and Trademark Office*